US009251769B1

(12) United States Patent
Adkins

(10) Patent No.: US 9,251,769 B1
(45) Date of Patent: Feb. 2, 2016

(54) MECHANICAL MUTE FOR SELECTIVELY MUTING A BRASS INSTRUMENT

(71) Applicant: Thomas C. Adkins, Austin, TX (US)

(72) Inventor: Thomas C. Adkins, Austin, TX (US)

( * ) Notice: Subject to any disclaimer, the term of this patent is extended or adjusted under 35 U.S.C. 154(b) by 14 days.

(21) Appl. No.: 14/460,451

(22) Filed: Aug. 15, 2014

(51) Int. Cl.
*G10D 9/06* (2006.01)

(52) U.S. Cl.
CPC ..... *G10D 9/06* (2013.01)

(58) Field of Classification Search
CPC ..... G10D 9/06
USPC ..... 84/400; D17/13
See application file for complete search history.

(56) References Cited

U.S. PATENT DOCUMENTS 1,338,108 A * 4/1920 Fortunato ..... G10D 9/06 84/400
2,439,733 A * 4/1948 Hermes ..... G10D 9/06 84/400

* cited by examiner

*Primary Examiner* — Jianchun Qin
(74) *Attorney, Agent, or Firm* — Law Office of Jim Boice

(57) ABSTRACT

A mute for a musical brass instrument comprises an external body and an adjustable muting device coupled to the external body. The adjustable muting device selectively mutes sound from the musical brass instrument. The adjustable muting device is a mechanical device, which is selectably activated and/or adjusted using mechanical and/or electronic controls, thus permitting a musician to mute/unmute the musical brass instrument without removing the mute.

5 Claims, 4 Drawing Sheets

MECHANICAL MUTE FOR SELECTIVELY MUTING A BRASS INSTRUMENT

BACKGROUND

The present disclosure relates to the field of musical instruments, and specifically to brass instruments. Still more particularly, the present disclosure relates to mechanical mutes used in conjunction with brass instruments.

A "brass instrument" is a musical instrument in the family of wind instruments that include, but are not limited to, trumpets, cornets, trombones, tubas, etc. Such instruments include a mouthpiece, into which the player blows air through pinched lips, which acts as a vibrating reed. Hence, brass instruments are sometimes referred to as being in the "lip-reed" family of musical instruments. The pinched air creates a sound that is amplified and/or modulated by a series of tubes. The passage of air through these tubes is controlled by finger buttons connected to valves and/or slides, thus controlling the pitch of the sound, which eventually exits the bell of the brass instrument.

SUMMARY

In one embodiment of the present invention, a mute for a musical brass instrument comprises an external body and an adjustable muting device coupled to the external body. The adjustable muting device selectively mutes sound from the musical brass instrument. The adjustable muting device is a mechanical device, which is selectably activated and/or adjusted using mechanical and/or electronic controls, thus permitting a musician to mute/unmute the musical brass instrument without removing the mute.

In one embodiment of the present invention, a musical brass instrument comprises a mute, wherein the mute comprises: an external body; and an adjustable muting device coupled to the external body, wherein the adjustable muting device selectively mutes sound from the brass instrument.

DETAILED DESCRIPTION

Figure 1:
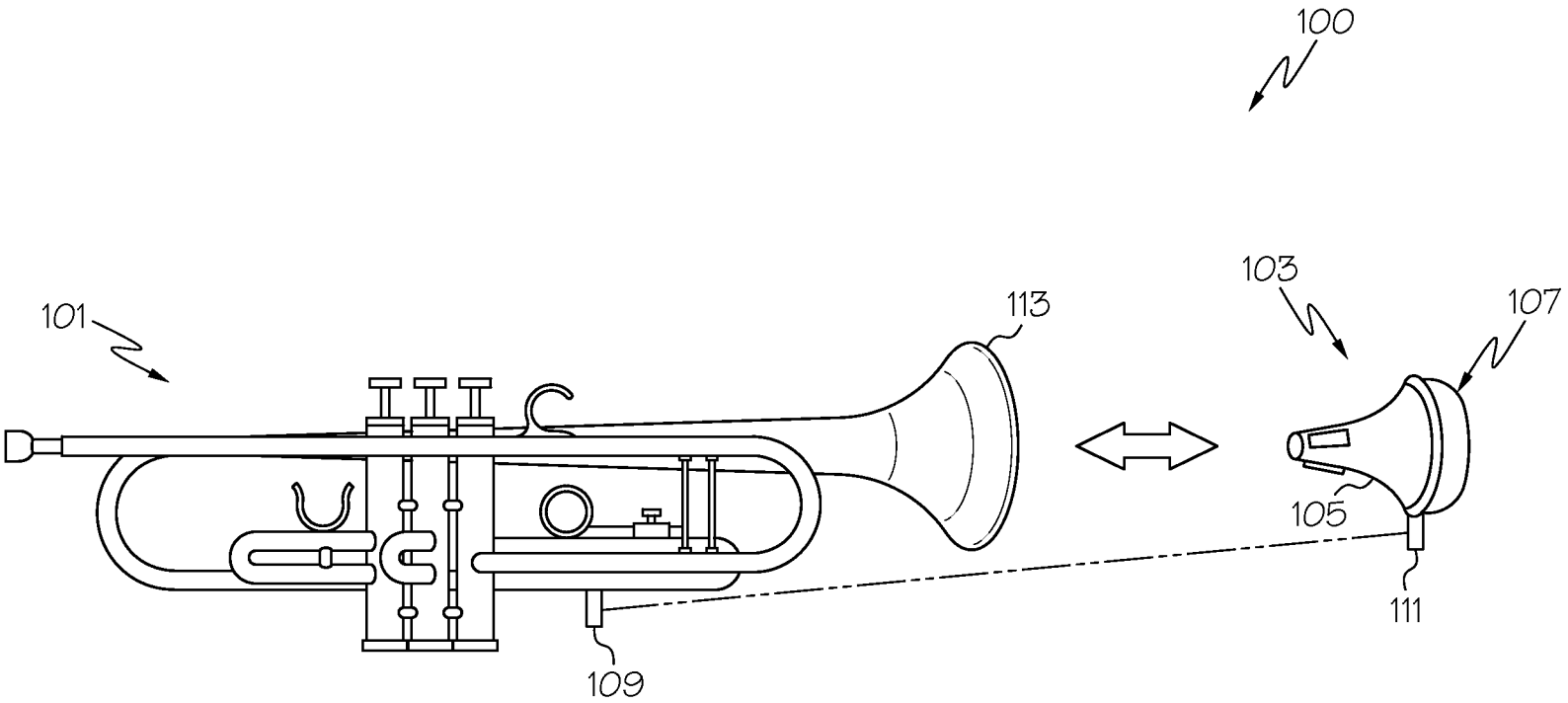
FIG. 1 depicts an exemplary new and novel mute that is attachable to a brass instrument.

With reference now to the figures, and particularly to FIG. 1, a mutable brass instrument 100 includes the main brass instrument itself, such as the depicted trumpet 101, and an insertable (i.e., removable) mute 103. Note that a variation of the mute 103 may be used on any brass instrument (i.e., any "brass" musical instrument, which may or not be constructed of brass), including but not limited to, a trumpet, a cornet, a tuba, a trombone, a bugle, etc. Note further that while in one embodiment the mute 103 is inserted in a removable manner into the trumpet 101, in another embodiment the mute 103 is a permanent component (i.e., not removable) of the trumpet 101. That is, in one embodiment the mute 103 is inserted into the trumpet 101, where it is secured to the trumpet 101 by friction, and thus can be easily removed. However, in another embodiment, the mute 103 is an integral component of the trumpet 101 (i.e., the mute 103 is a component in the construction of the trumpet 101), such that the mute 103 is a permanent feature of the trumpet 101.

As depicted, mute 103 has an external body 105, to which is affixed an adjustable muting device 107. The adjustable muting device 107 is controlled by a player of the trumpet 101 by a controller 111. In one or more embodiments of the present invention, the controller is controlled by a switch 109, which is mechanically, electrically, and/or wirelessly coupled to the controller 111. In one embodiment, controller 111 is a simple mechanical device, such as a lever, that controls the operation of the adjustable muting device 107. In other embodiments, controller 111 is an electro-mechanical device, as described herein.

Figure 2:
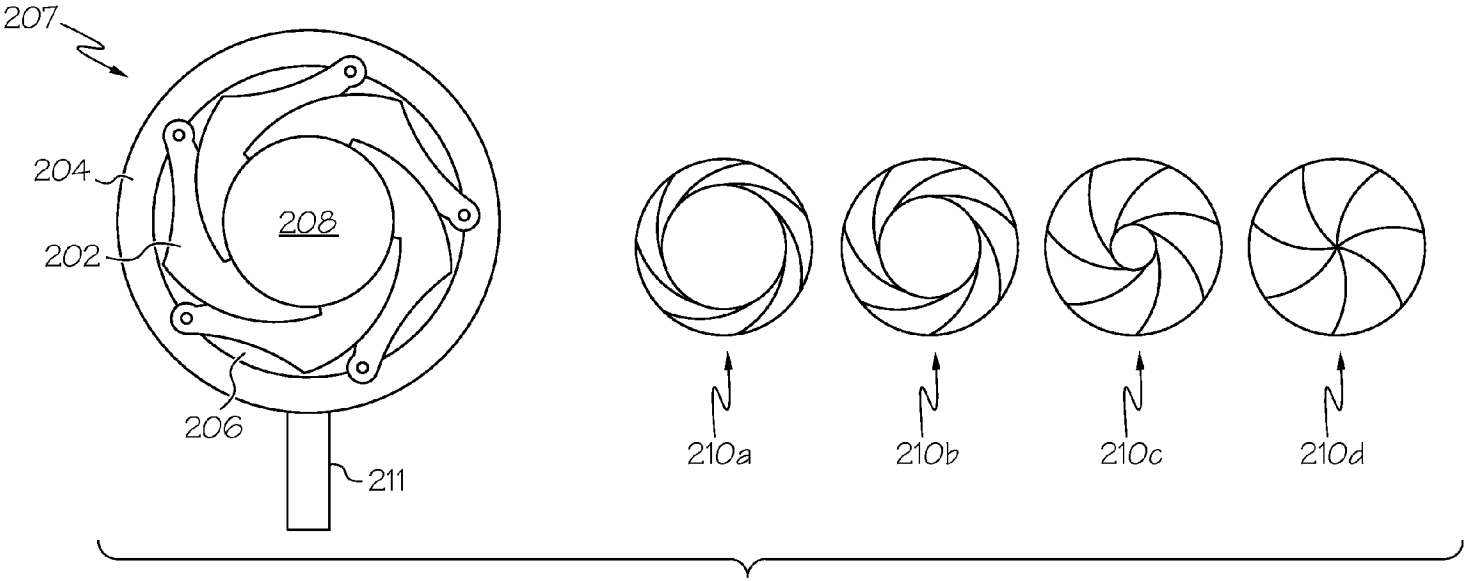
FIG. 2 illustrates a front view of an exemplary adjustable aperture mechanism in the mute depicted in FIG. 1.

Referring now to FIG. 2, a front view (i.e., looking towards the bell 113 of the trumpet 101) of an exemplary adjustable aperture mechanism 207 (analogous to the adjustable muting device 107 depicted in FIG. 1) is presented. In FIG. 2, the adjustable aperture mechanism 207 is a radial mechanism, in which a series of vanes (e.g., vane 202) are movably coupled at each end to an outer ring 204 and an inner ring 206. When a user pushes against a controller 211 (e.g., a tab that is affixed to the outer finger 204), the outer ring 204 rotates relative to the concentric inner ring 206, and the connected vanes (including vane 202) articulate to open and close the aperture 208 of the adjustable aperture mechanism 207. This movement of the vanes and rings causes the aperture to be fully open (as shown in view 210*a*), fully closed (as shown in view 210*d*), or some level of opened/closed as shown in views 210*a*-210*c*. Thus, when aperture 208 is fully open (as shown in view 210*a*), air coming from the brass instrument is unobstructed, and thus the sound is unmuted. However, when aperture 208 is partially or fully closed (as shown in views 210*b*-210*d*), the air is restricted, and thus the sound from the brass instrument is muted.

Thus, returning again to FIG. 1, assume that mute 103 has been inserted into the bell 113 of the trumpet 101. Assume further that the adjustable muting device 107 incorporates the mechanism of the adjustable aperture mechanism 207 shown in FIG. 2. Assume further that the user has moved the controller 111/211 to fully open the aperture 208 depicted in FIG. 2. This condition allows all sound/air to exit the bell 113 in an unobstructed manner, such that the sound from the trumpet 101 is unmuted. However, by moving the controller 111/211 in a different direction, the aperture 208 depicted in FIG. 2 becomes smaller and smaller, such that the sound from the trumpet becomes more and more muted.

Note that while the inner ring 206 and the outer ring 204 of the adjustable aperture mechanism 207 must be constructed of a rigid material such as hard plastic, metal, etc., the vanes (e.g., vane 202) may be constructed of a rigid material (i.e., hard plastic, metal, etc.) or a flexible material (e.g., cloth, paper, etc.), assuming that the vanes have a rigid supporting structure (not shown) for coupling to the inner ring 206 and the outer ring 204.

Figure 3:
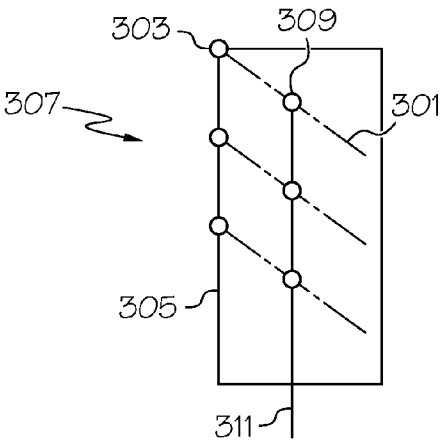
FIG. 3 depicts a cross-section of an exemplary adjustable louver mechanism in the mute depicted in FIG. 1.

With reference now to FIG. 3, an alternative embodiment for the mechanical device used to mute sounds coming from the bell of a brass instrument is depicted as adjustable louver mechanism 307 (also analogous to the adjustable muting device 107 shown in FIG. 1), which is depicted in cross-section (i.e., a side view of the mute 103 shown in FIG. 1). As shown, adjustable louver mechanism 307 has a series of slats (e.g., slat 301), which are hinged (e.g., hinge 303) to a body 305 (analogous to external body 105 shown in FIG. 1) of the mute. Each of the slats is hinged to a controller 311 (e.g., a control rod that is analogous to controller 111 in FIG. 1), which allows the user to open and close the plenum of the mute's body 305 by pushing the controller 311 up and down.

Figure 4:
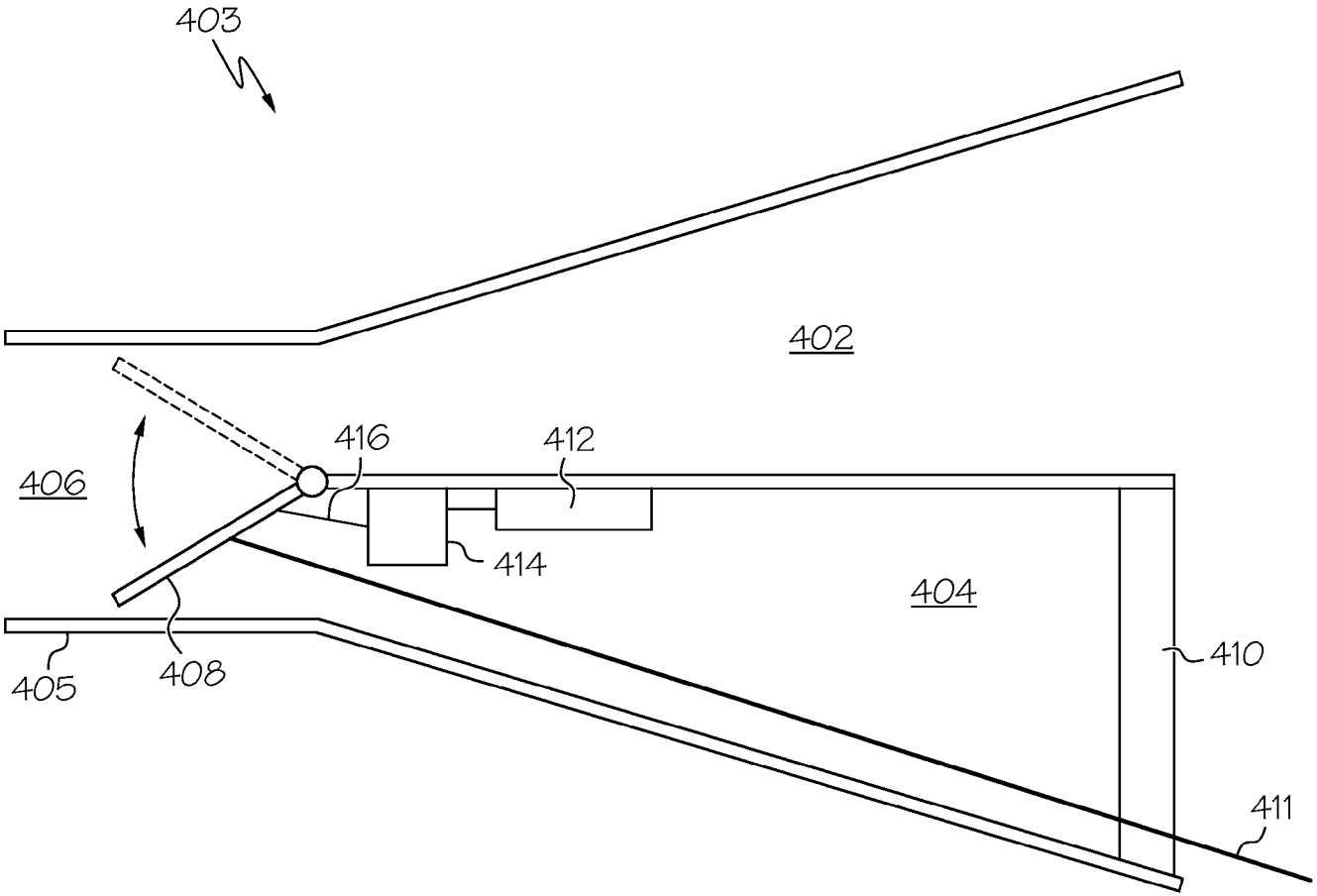
FIG. 4 illustrates a cross-section of an embodiment of the mute depicted in FIG. 1 in which a bifurcated chamber selectively directs air to an open bell chamber or a muted bell chamber in the mute.

While FIG. 2 and FIG. 3 depict exemplary new and novel adjustable muting mechanisms that are affixed to the end of the mute 103 shown in FIG. 1, FIG. 4 illustrates a new and novel adjustable muting mechanism that is internal to the mute 103. As depicted in the cross-section of mute 403 (analogous to the mute 103 shown in FIG. 1), mute 403 uses a bifurcated chamber to selectively direct air to an open bell chamber 402 or a muted bell chamber 404. That is, air from the brass instrument initially enters the intake chamber 406. A flap valve 408, which in one embodiment is controlled by a control rod such as the depicted mechanical controller 411 (analogous to controller 111 shown in FIG. 1), selectively directs air passage to the open bell chamber 402 or the muted bell chamber 404. If the air (and thus sound) is directed to the open bell chamber 402, then the sound from the brass instrument is unmuted. However, if the air (and thus sound) is directed to the muted bell chamber 404, a mute cover 410 mutes the sound. In one embodiment, the mute cover 410 is a fixed muting material, such as foam, fabric, baffled plastic or metal, etc. In another embodiment, the mute cover 410 uses an adjustable mechanism (e.g., as shown in FIG. 2 and/or FIG. 3), thus allowing further control of how much muting occurs.

Note that in one embodiment, the flap valve 408 is infinitely adjustable by pushing the mechanical controller 411 a limited distance (rather than fully occluding one of the passageways to the open bell chamber 402 or the muted bell chamber 404). This allows different percentages of air/sound to be directed to the open bell chamber 402 and the muted bell chamber 404, thus adjusting the level of muting that occurs.

With further reference to FIG. 4, in one embodiment the mute 403 includes an electronic controller 412. Electronic controller 412 is electrically coupled to an electro-mechanical actuator 414, which moves linkage 416, which controls the movement of flap valve 408.

Figure 5:
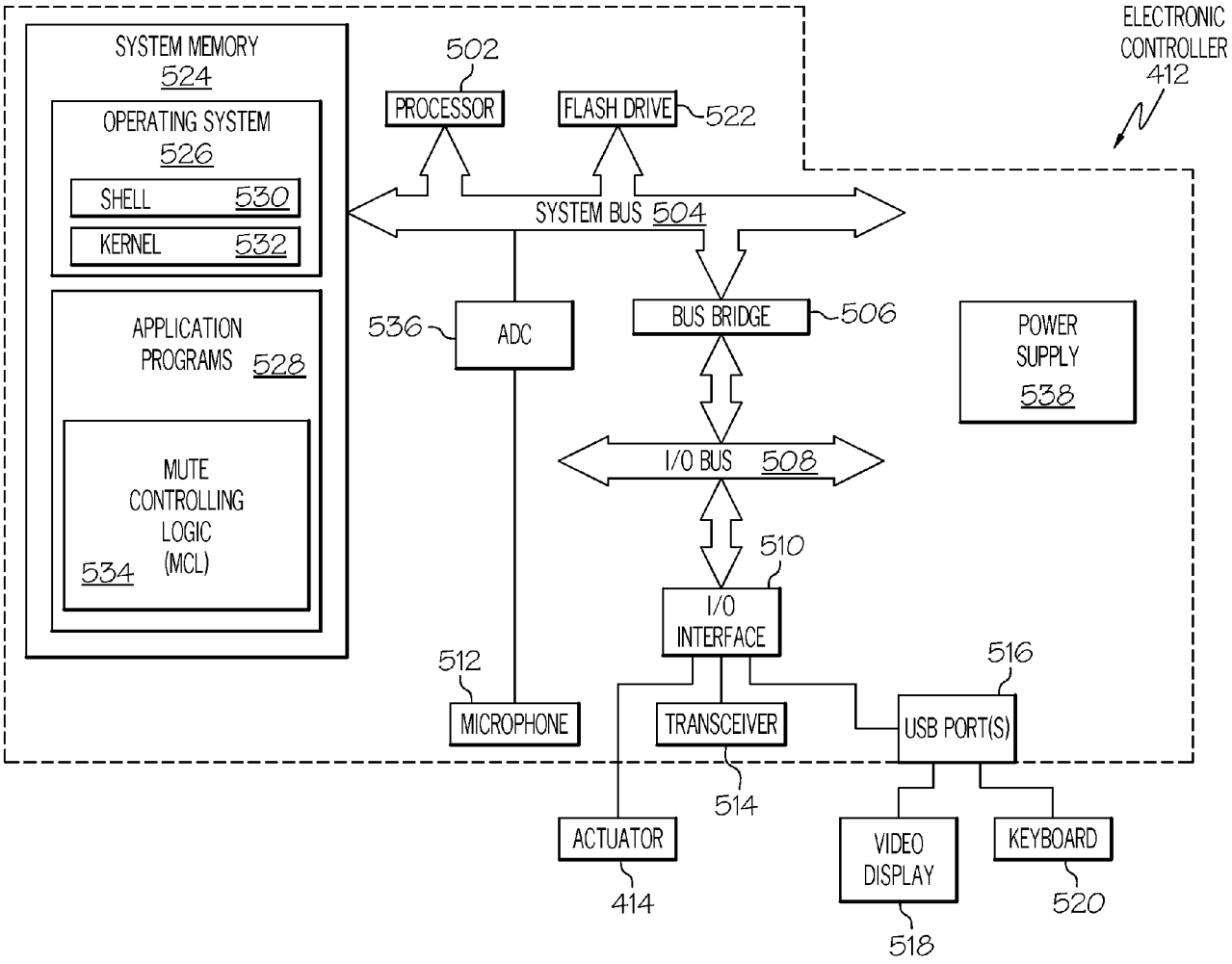
FIG. 5 depicts additional detail of an electronic controller illustrated in FIG. 4.

With reference now to FIG. 5, additional detail of the electronic controller 412 illustrated in FIG. 4 is presented. Exemplary electronic controller 412 includes a processor 502 that is coupled to a system bus 504. System bus 504 is coupled via a bus bridge 506 to an input/output (I/O) bus 508. An I/O interface 510, which is coupled to I/O bus 114, affords communication with various I/O devices, including a microphone 512, the actuator 414 shown in FIG. 4, and a transceiver 514 (which his able to transmit and receive wireless signals such as radio frequency (RF) signals, infrared (IR) signals, etc.). I/O interface 510 is also electrically coupled to one or more universal serial bus (USB) port(s) 516, which may utilize the USB format or, alternatively, any I/O format capable of interfacing with the electronic controller 412.

The USB port(s) 516 thus provide an interface to a video display 518 and/or a keyboard 520, which may be used to communicate with the electronic device 412, particularly when loading data into a flash drive 522, which is also coupled to system bus 504. In one embodiment, flash drive 522 populates a system memory 524, which is also coupled to system bus 504. Data that populates system memory 524 includes the electronic controller's operating system (OS) 526 and application programs 528.

OS 526 includes a shell 530, for providing transparent user access to resources such as application programs 528. Generally, shell 530 is a program that provides an interpreter and an interface between the user and the operating system. More specifically, shell 530 executes commands that are entered into a command line user interface or from a file. Thus, shell 530, also called a command processor, is generally the highest level of the operating system software hierarchy and serves as a command interpreter. The shell provides a system prompt, interprets commands entered by keyboard, mouse, or other user input media, and sends the interpreted command(s) to the appropriate lower levels of the operating system (e.g., a kernel 532) for processing.

As depicted, OS 526 also includes kernel 532, which includes lower levels of functionality for OS 526, including providing essential services required by other parts of OS 526 and application programs 528, including memory management, process and task management, flash drive management, and keyboard management.

Application programs 528 in electronic controller 412's system memory also include a Mute Controlling Logic (MCL) 534. MCL 534 includes code for implementing the processes and/or procedures described herein.

Note that the electronic controller 412 also includes a power supply 538, which preferably is a battery power source.

Returning now to FIG. 4, electronic controller 412 provides various functionalities.

In one embodiment, electronic controller 412 acts as a wireless receiver (e.g., using transceiver 514 shown in FIG. 5) of control signals from the player of the brass instrument or another person. For example, a wireless transmitter switch (not depicted) may be mounted on the trumpet 101 shown in FIG. 1, or it may be located on the floor, at a conductor's podium, etc. When the switch is activated, the electronic controller 412 receives the wireless signal, thus causing the electro-mechanical actuator 414 to move linkage 416, thereby moving the positioning of the flap valve 408 in order to adjust the level of sound muting.

In one embodiment, electronic controller 412 acts as "smart" controller. That is, by using the keyboard 520 shown in FIG. 5, a user can program a certain series of notes into the flash drive 522 as a digital signature. This digital signature is then provided to processor 502 (which is executing MCL 534) as a "trigger" signal, such that whenever the microphone 512 in the electronic controller 412 detects the series of notes that constitute the digital signature, the actuator 414 will move the flap valve 408. That is, analog signals (of musical notes being played by the brass instrument) that are received from microphone 512 in FIG. 5 are converted into digital signals by an Analog-to-Digital Converter (ADC) 536, which produces a digital representation of one or more notes played on the brass instrument. Comparing these series of notes to the series of notes stored in the flash drive 522, and then automatically muting the brass instrument when the two series match, allows the system to automatically mute/unmute the brass instrument according to pre-determined passages within a particular musical composition.

Note that the terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of various embodiments of the present invention has been presented for purposes of illustration and description, but is not intended to be exhaustive or limited to the present invention in the form disclosed. Many modifications and variations will be apparent to those of ordinary skill in the art without departing from the scope and spirit of the present invention. The embodiment was chosen and described in order to best explain the principles of the present invention and the practical application, and to enable others of ordinary skill in the art to understand the present invention for various embodiments with various modifications as are suited to the particular use contemplated.

Having thus described embodiments of the present invention of the present application in detail and by reference to illustrative embodiments thereof, it will be apparent that modifications and variations are possible without departing from the scope of the present invention defined in the appended claims.

What is claimed is:

1. A mute for a brass instrument, the mute comprising:
an external body; and
an adjustable muting device coupled to the external body, wherein the adjustable muting device is a mechanical device that selectively mutes sound from the brass instrument, wherein the adjustable muting device comprises an adjustable aperture mechanism, and wherein the adjustable aperture mechanism comprises:
a series of vanes;
an inner ring movably coupled to a first end of each vane from the series of vanes;
an outer ring movably coupled to a second end of each vane from the series of vanes, wherein the inner ring and the outer ring are concentric; and
a controller, wherein movement of the controller rotates the outer ring to force the series of vanes to open and close an aperture through which air from the brass instrument is expelled.

2. A mute for a brass instrument, the mute comprising:
an external body; and
an adjustable muting device coupled to the external body, wherein the adjustable muting device is a mechanical device that selectively mutes sound from the brass instrument, and wherein the adjustable muting device comprises:
an adjustable louver mechanism, wherein the adjustable louver mechanism comprises:
a series of slats that are hinged to the external body of the mute; and
a control rod movably connected to each of the series of slats, wherein movement of the control rod opens and closes an opening through which air from the brass instrument is expelled.

3. A mute for a brass instrument the mute comprising:
an external body; and
an adjustable muting device coupled to the external body, wherein the adjustable muting device is a mechanical device that selectively mutes sound from the brass instrument, and wherein the adjustable muting device comprises:
an intake chamber;
an open bell chamber through which air and sound from the intake chamber pass unobstructed;
a muted bell chamber through which air and sound from the intake chamber pass through a mute cover; and
a flap valve that selectively opens and closes passageways from the intake chamber to the open bell chamber and the muted bell chamber.

4. The mute of claim 3, further comprising:
an actuator mechanically coupled to the flap valve; and
an electronic controller electrically coupled to the actuator, wherein the electronic controller comprises:
a wireless receiver, wherein the wireless receiver receives wireless signals that control the actuator.

5. The mute of claim 3, further comprising:
an actuator mechanically coupled to the flap valve; and
an electronic controller electrically coupled to the actuator, wherein the electronic controller comprises:
a microphone for detecting notes being played by the brass instrument;
a memory that holds a digital copy of a predetermined set of notes; and
a processor, wherein the processor directs the actuator to move in response to the microphone detecting the predetermined set of notes being played in real time on the brass instrument.

* * * * *